US008485596B1

(12) United States Patent
Martin

(10) Patent No.: US 8,485,596 B1
(45) Date of Patent: Jul. 16, 2013

(54) STADIUM BLANKET WITH SEAT

(76) Inventor: Kathy J. Martin, Palm Desert, CA (US)

( * ) Notice: Subject to any disclaimer, the term of this patent is extended or adjusted under 35 U.S.C. 154(b) by 262 days.

(21) Appl. No.: 13/010,094

(22) Filed: Jan. 20, 2011

(51) Int. Cl.
*A47C 7/66* (2006.01)

(52) U.S. Cl.
USPC ..... 297/184.14; 2/84

(58) Field of Classification Search
USPC ..... 297/184.1, 184.14, 180.12; 2/84
See application file for complete search history.

(56) References Cited

U.S. PATENT DOCUMENTS

| | | | | |
|---|---|---|---|---|
| 3,835,471 | A * | 9/1974 | Lankford | 2/84 X |
| 4,035,606 | A * | 7/1977 | Browder | 219/211 X |
| 4,826,242 | A * | 5/1989 | Trethewey | 297/184.14 |
| D336,986 | S | 7/1993 | Seymour | |
| 5,414,881 | A | 5/1995 | Terrazas | |
| 5,657,489 | A | 8/1997 | Ponstein | |
| 5,884,331 | A | 3/1999 | Barajas | |
| 5,946,723 | A | 9/1999 | DiPrato et al. | |
| 6,223,367 | B1 | 5/2001 | French et al. | |
| 6,851,127 | B1 | 2/2005 | Khan | |
| 7,319,207 | B2 | 1/2008 | Campf et al. | |
| 7,802,844 | B1 * | 9/2010 | Vencill | 297/184.14 |
| 2003/0061659 | A1 | 4/2003 | Dunlap et al. | |

OTHER PUBLICATIONS

Kathy J. Martin; Statement regarding audition for "American Inventor" show on ABC network on Mar. 18, 2007, not published.

* cited by examiner

*Primary Examiner* — Anthony D Barfield

(57) ABSTRACT

A blanket is featured with a stadium built-in seat. The blanket can optionally further comprise, a hood, air-activated warmer pockets, a fleece interior and an exterior sports (e.g., football field) design. The blanket can be worn while attending outdoor sports events in cold weather, and it is easy to fold and transport.

15 Claims, 4 Drawing Sheets

(ISO View)

(Back View)

(Side View)

(Front View)

(In-use View)

(Alternate Design Versions)

STADIUM BLANKET WITH SEAT

BACKGROUND OF THE INVENTION

The present invention features a built-in stadium seat, and optionally, a hood, air-activated warmer pockets, a fleece interior and an exterior sports (e.g., football field) design. The blanket can be worn while attending outdoor sports events in cold weather, and it is easy to fold and transport.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
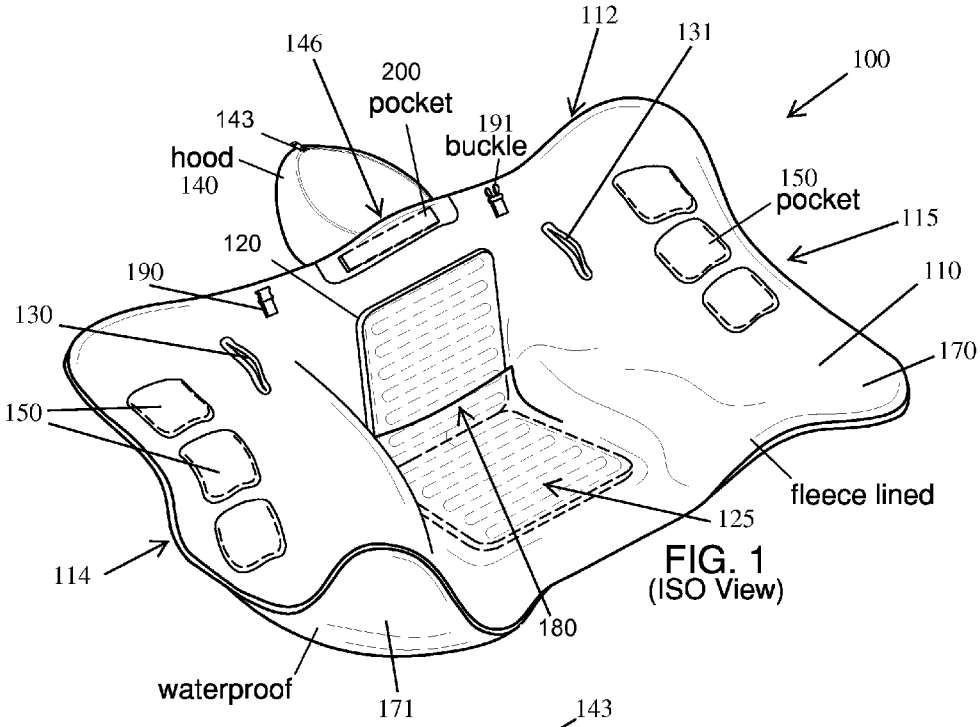
FIG. 1 shows an interior perspective view of the stadium blanket.
Figure 2:
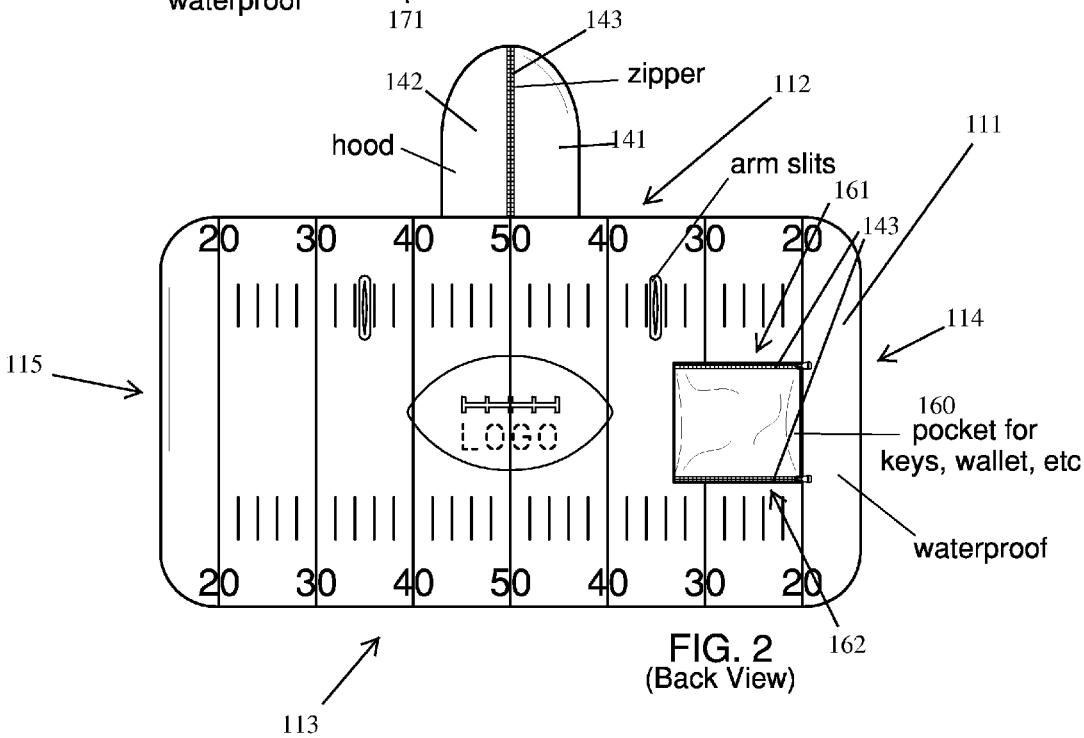
FIG. 2 shows a back view of the stadium blanket.
Figure 3:
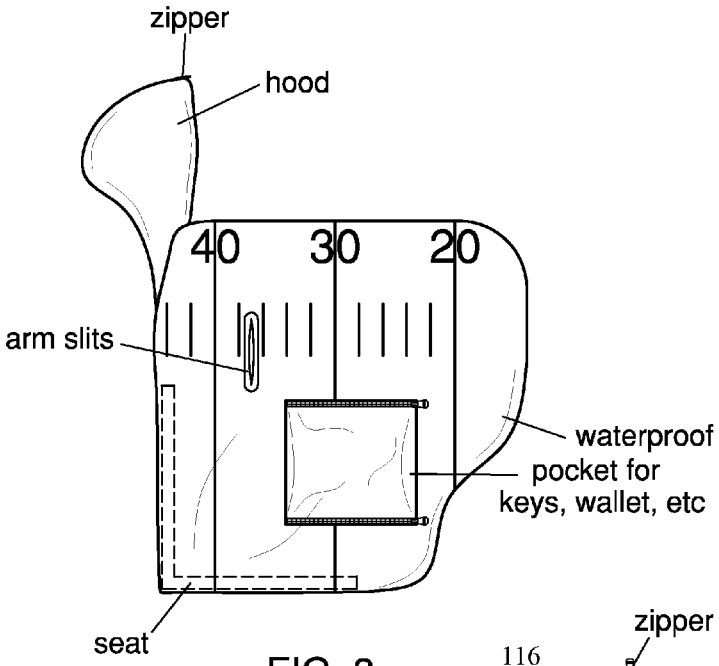
FIG. 3 shows a side view of the stadium blanket.
Figure 4:
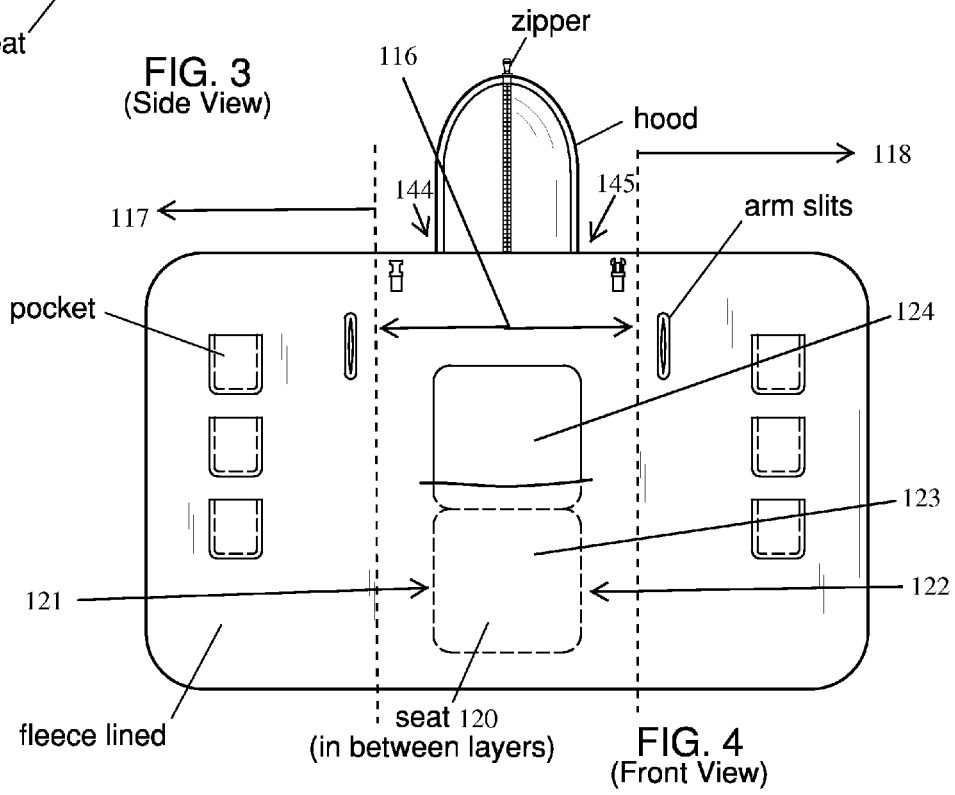
FIG. 4 shows a front view of the stadium blanket.
Figure 5:
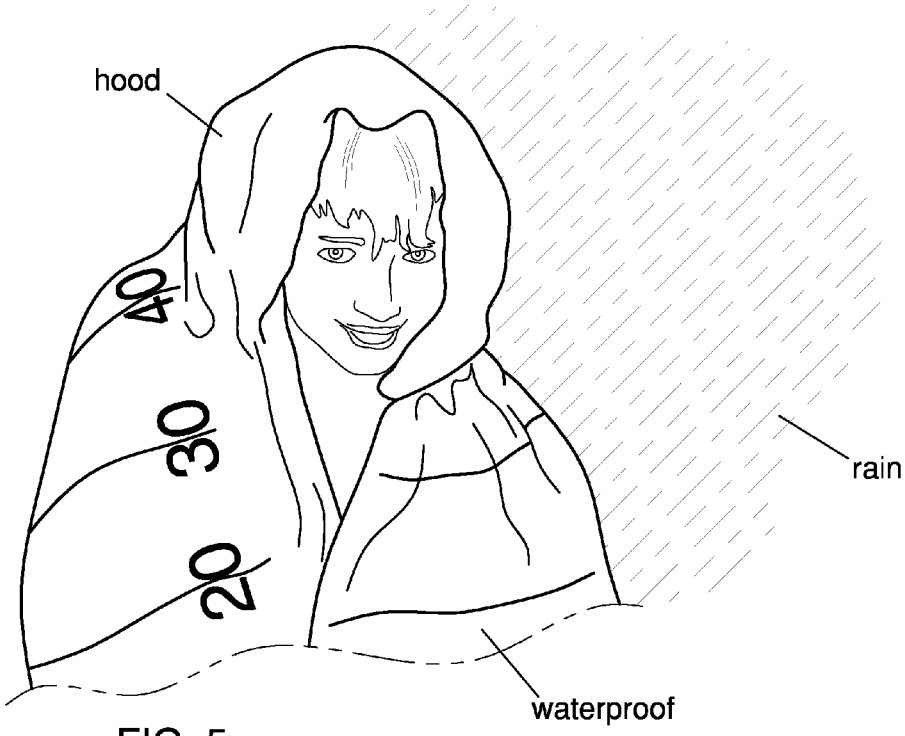
FIG. 5 shows an in-use view of the stadium blanket.
Figure 6:
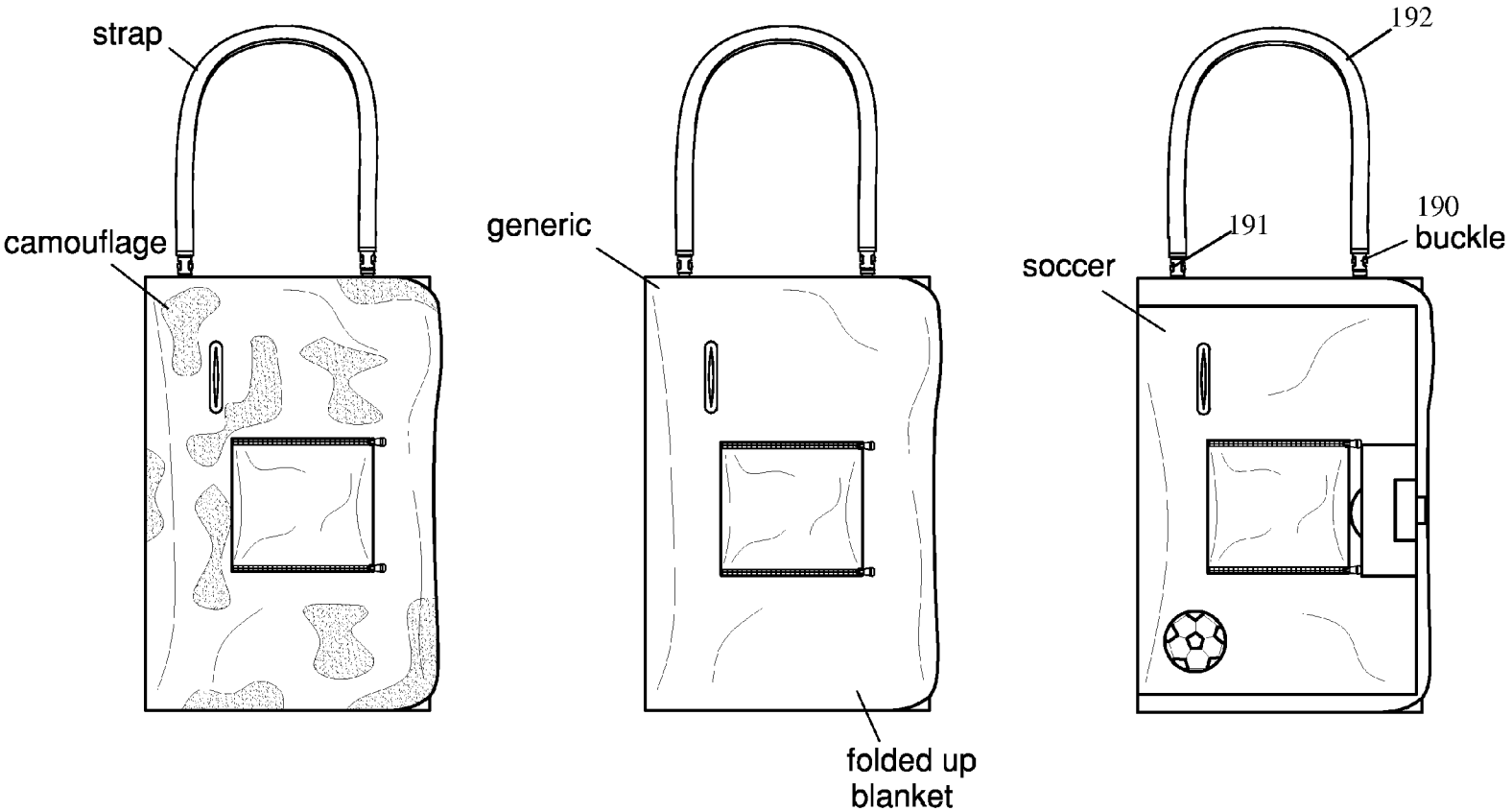
FIG. 6 shows the folded up blanket with various exterior designs.

Referring now to FIGS. 1-6, the present invention features a stadium blanket 100 comprising an inside blanket surface 110, an outside blanket surface 111, a top blanket edge 112, a bottom blanket edge 113, a first side blanket edge 114 and a second side blanket edge 115. The stadium blanket 100 further comprises a seat 120 fixably disposed in a mid-region of the blanket 116. The seat has a first seat side 121 and a second seat side 122. The stadium blanket is divided into three regions: a mid-region 116 being in the middle of the blanket, a first blanket region 117 being between the first side blanket edge 114 and first seat edge 121, and a second blanket region 118 being between the second blanket edge 115 and the second seat side 122. The outside blanket surface 111 may have imprints of various themes, e.g., sport themes such as a football field goal, etc. In some embodiments, the blanket 100 has a rectangular shape. In some embodiments, the blanket has a width of about 4 feet. In some embodiments, the blanket may have any geometric shape, e.g., square, oval, triangular, etc.

In some embodiments, the stadium blanket 100 further comprises a first slot 130 through the blanket 100, wherein the first slot 130 is disposed at the first blanket region 117, and a second slot 131 through the blanket 100, wherein the second slot 131 is disposed at the second blanket region 118. The first and second slots 130/131 functions as arm slits for a person to insert an arm there through.

In some embodiments, the stadium blanket 100 further comprises a hood 140 disposed at the top blanket edge 112 above the seat 120. The hood 140 may comprise a first half 141 of the hood attached to a second half 142 of a hood via an attachment means 143. An attachment means 143 may include a zipper, a hook and loop mechanism, buttons, and the like.

In some embodiments, the stadium blanket 100 further comprises one or more inside pockets 150 disposed at the first blanket region 117 on the inside blanket surface 110. In some embodiments, the stadium blanket 100 further comprises one or more inside pockets 150 disposed at the second blanket region 118 on the inside blanket surface 110. For example, the stadium blanket may have three inside pockets 150 disposed at the first and/or second blanket region 117/118.

In some embodiments, the stadium blanket 100 further comprises an outside pocket 160 disposed at the first 117 or second 118 blanket region on the outside blanket surface 111. In some embodiments, the outside pocket 160 has a first opening 161 that can be sealed off with an attachment means 143 and a second opening 162 directly opposite of the first opening 161 that can also be sealed off with an attachment means 143. Effectively, the outside pocket may be opened on the "upper" side or the "lower" end.

in some embodiments, the inside blanket surface 110 of the stadium blanket is lined with a first material 170 and the outside blanket surface 111 is lined with a second material 171. For example, the inside blanket surface may be lined with a fleece material and/or the outside blanket surface may be lined with a water proof material such as a plastic.

In some embodiments, the stadium blanket 100 further comprises a slit 180 in the first material 170 at the mid-region of the blanket 116, wherein the seat 120 is at least partially inserted into the slit 180 and is secured therein. For example, the slit is a cut running parallel to the top and bottom edge of the blanket, wherein the slit is wide enough to accommodate a the width of a seat. In some embodiments, the seat may be fixably attached to the blanket via an attachment means, e.g., buttons, hook-and-loop, glue, strings, and the like.

In some embodiments, the seat 120 comprises a lower section 123 pivotably attached to an upper section 124, wherein the lower section 123 is for a person to sit on and the upper section 124 is for the person to rest his or her back on. The seat may be constructed from a hard material such as plastic, metal, alloy, wood or combination thereof. The seat may also be constructed from a soft material such as pillow foam, pillow cotton, rubber and the like. In some embodiments, the seat is lined with a heating coil 125, wherein the heating coil 125 is powered by a power source, such as a battery. The heating coil may be operably connected to an on/off switch, and the on off switch operably connected to the power source such as the battery, wherein the power source provides power to the heating coil.

In some embodiments, the stadium blanket 100 further comprises a first buckle 190 disposed toward the top blanket edge 112 on a first hood side 144, and a second buckle 191 disposed toward the top blanket edge 112 on a second hood side 145. A strap 192 can be attached between the first 190 and second buckle 191 wherein the strap 192 is used for carrying the stadium blanket 100 when the stadium blanket is folded up. See FIG. 6.

In some embodiments, the stadium blanket 100 further comprises a neck pocket 200 disposed at the top blanket edge 112 at a base of the hood 146, the neck pocket 200 is used for storing a heat pad therein.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A stadium blanket 100 comprising:

(a) an inside blanket surface 110, an outside blanket surface 111, a top blanket edge 112, a first side blanket edge 114 and a second side blanket edge 115;

(b) a seat 120 fixably disposed in a mid-region of the blanket 116, the seat having a first seat side 121 and a second seat side 122;

(c) a first blanket region 117 being between the first side blanket edge 114 and first seat edge 121, and a second blanket region 118 being between the second blanket edge 115 and the second seat side 122;

(d) a hood 140 disposed at the top blanket edge 112 above the seat 120, wherein the hood 140 comprises a first half 141 of the hood removably attached to a second half 142 of the hood via a temporary, releasable attachment means 143; and (e) an outside pocket 160 disposed at the first 117 or second 118 blanket region on the outside blanket surface 111, the outside pocket 160 has a first opening 161 that can be sealed off with an temporary, releasable attachment means 143 and a second opening 162 directly opposite of the first opening 161 that can also be sealed off with an attachment means 143.

2. The stadium blanket 100 of claim 1 comprising:

(a) a first slot 130 through the blanket 100, wherein the first slot 130 is disposed at the first blanket region 117;

(b) a second slot 131 through the blanket 100, wherein the second slot 131 is disposed at the second blanket region 118.

3. The stadium blanket 100 of claim 1 comprising one or more inside pockets 150 disposed at the first blanket region 117 on the inside blanket surface 110.

4. The stadium blanket of claim 1 comprising one or more inside pockets 150 disposed at the second blanket region 118 on the inside blanket surface 110.

5. The stadium blanket 100 of claim 1 wherein the inside blanket surface 110 is lined with a first material 170 and the outside blanket surface 111 is lined with a second material 171.

6. The stadium blanket 100 of claim 5 wherein the first material is fleece.

7. The stadium blanket 100 of claim 5 wherein the second material is a water proof material.

8. The stadium blanket 100 of claim 5 comprising a slit 180 in the first material 170 at the mid-region of the blanket 116, wherein the seat 120 is at least partially inserted into the slit 180 and is secured therein.

9. The stadium blanket 100 of claim 1 wherein the seat 120 comprises a lower section 123 pivotably attached to an upper section 124, wherein the lower section 123 is for a person to sit on and the upper section 124 is for the person to rest his or her back on.

10. The stadium blanket 100 of claim 1 wherein the seat is constructed from a hard material.

11. The stadium blanket 100 of claim 1 wherein the seat is constructed from a soft material.

12. The stadium blanket 100 of claim 1 wherein the seat is lined with a heat coil 125, wherein the heat coil is powered by a power source.

13. The stadium blanket 100 of claim 1 comprising a first buckle 190 disposed toward the top blanket edge 112 on a first hood side 144, and a second buckle 191 disposed toward the top blanket edge 112 on a second hood side 145, a strap 192 can be attached between the first 190 and second buckle 191 wherein the strap 192 is used for carrying the stadium blanket 100 when the stadium blanket is folded up.

14. The stadium blanket 100 of claim 1 comprising a neck pocket 200 disposed at the top blanket edge 112 at a base of the hood 146, the neck pocket 200 is used for storing a heat pad therein.

15. A stadium blanket 100 consisting of:

(a) an inside blanket surface 110, an outside blanket surface 111, a top blanket edge 112, a first side blanket edge 114 and a second side blanket edge 115;

(b) a seat 120 fixably disposed in a mid-region of the blanket 116, the seat having a first seat side 121 and a second seat side 122;

(c) a first blanket region 117 being between the first side blanket edge 114 and first seat edge 121, and a second blanket region 118 being between the second blanket edge 115 and the second seat side 122;

(d) a hood 140 disposed at the top blanket edge 112 above the seat 120, wherein the hood 140 consists of a first half 141 of the hood removably attached to a second half 142 of the hood via an attachment means 143; and (e) an outside pocket 160 disposed at the first 117 or second 118 blanket region on the outside blanket surface 111, the outside pocket 160 has a first opening 161 that can be sealed off with an attachment means 143 and a second opening 162 directly opposite of the first opening 161 that can also be sealed off with an attachment means 143.

* * * * *